US009506684B2

(12) United States Patent
Junge et al.

(10) Patent No.: US 9,506,684 B2
(45) Date of Patent: Nov. 29, 2016

(54) REFRIGERATOR APPLIANCE

(71) Applicant: General Electric Company, Schenectady, NY (US)

(72) Inventors: Brent Alden Junge, Evansville, IN (US); Marcelo Torrentes, Miami Gardens, FL (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 221 days.

(21) Appl. No.: 14/149,901

(22) Filed: Jan. 8, 2014

(65) Prior Publication Data

US 2015/0192349 A1 Jul. 9, 2015

(51) Int. Cl.
*F25D 21/14* (2006.01)

(52) U.S. Cl.
CPC ..... *F25D 21/14* (2013.01); *F25D 2321/146* (2013.01); *F25D 2321/1442* (2013.01)

(58) Field of Classification Search
CPC ..... F25D 2321/1441; F25D 2321/146; F25D 2321/1442
USPC ..... 62/289, 291, 288
See application file for complete search history.

(56) References Cited

U.S. PATENT DOCUMENTS 525,668 A 9/1894 Schuberth
2,319,522 A * 5/1943 Schweller ..... F25D 11/02 62/118
2,358,591 A * 9/1944 Pugatz ..... C02F 1/686 137/114
2,485,115 A * 10/1949 Saunders ..... F25D 21/14 137/247.35
2,875,593 A * 3/1959 Mattingly ..... F25B 39/04 62/188
3,210,956 A * 10/1965 Maier ..... B60H 1/3233 62/186
5,428,968 A * 7/1995 Tetsukawa ..... A47F 3/0404 312/116
6,976,367 B2 * 12/2005 Spanger ..... F24F 13/222 3/222
2011/0000248 A1 * 1/2011 Jeong ..... F25C 1/04 62/344

FOREIGN PATENT DOCUMENTS

CN 2690463 Y 4/2005
KR 20020044402 A 6/2002
WO WO 2004086154 A2 10/2004

* cited by examiner

*Primary Examiner* — Allen Flanigan
*Assistant Examiner* — Filip Zec
(74) *Attorney, Agent, or Firm* — Dority & Manning, P.A.

(57) ABSTRACT

A refrigerator appliance is provided. The refrigerator appliance includes an evaporation pan and a drain conduit for directing liquid to the evaporation pan. A reservoir is coupled to the drain conduit. The reservoir includes a tank positioned above the evaporation pan, a plug assembly and a float mounted to the plug assembly. A position of the float varies depending upon a height of water within the tank, and the plug assembly seals the reservoir when the position of the float is at a particular position.

11 Claims, 7 Drawing Sheets

REFRIGERATOR APPLIANCE

FIELD OF THE INVENTION

The present subject matter relates generally to refrigerator appliances.

BACKGROUND OF THE INVENTION

Certain refrigerator appliances utilize a sealed system for cooling chilled chambers of the refrigerator appliances. During operation of the sealed system, water can condense on an evaporator of the sealed system. Over time, frost buildup on the evaporator can grow in size until it negatively affects operation of the refrigerator appliance. Accordingly, certain refrigerator appliance include a defrost cycle during which such frost buildup melts and is removed from the evaporator.

When the frost buildup melts, a significant amount of liquid (e.g., water) can be generated. In certain refrigerator appliances, such liquid is directed to a drain pan disposed outside of the chilled chamber wherein the liquid evaporates. However, because a significant amount of liquid can be generated, a significant amount of time may be needed for the liquid to evaporate.

Certain refrigerator appliances also include an ice maker and an ice bucket. The ice bucket can receive and store ice cubes produced by the ice maker. The ice bucket is generally maintained at a temperature below the freezing temperature of water in order to prevent ice cubes stored therein from melting. However, the ice cubes within the ice bucket can melt if the sealed system of the refrigerator appliance is deactivated. The sealed system can deactivate when an electrical supply to the refrigerator appliance is interrupted.

Melting ice cubes within the ice bucket can generate a significant amount of liquid. In certain refrigerator appliances, such liquid is directed to the drain pan and evaporated. However, because a significant amount of liquid can be generated, a significant amount of time may be needed for the liquid to evaporate.

Accordingly, a refrigerator appliance with features for containing and regulating a large volume of liquid runoff from an evaporator and/or an ice bucket of the refrigerator appliance refrigerator appliance would be useful.

BRIEF DESCRIPTION OF THE INVENTION

The present subject matter provides a refrigerator appliance. The refrigerator appliance includes an evaporation pan and a drain conduit for directing liquid to the evaporation pan. A reservoir is coupled to the drain conduit. The reservoir includes a tank positioned above the evaporation pan, a plug assembly and a float mounted to the plug assembly. A position of the float varies depending upon a height of water within the tank, and the plug assembly seals the reservoir when the position of the float is at a particular position. Additional aspects and advantages of the invention will be set forth in part in the following description, or may be apparent from the description, or may be learned through practice of the invention.

In a first exemplary embodiment, a refrigerator appliance is provided. The refrigerator appliance includes a cabinet that defines a chilled chamber and a mechanical chamber. The refrigerator appliance also includes an ice bucket and an evaporation pan positioned within the mechanical chamber of the cabinet. A drain conduit extends between the ice maker and the evaporation pan in order to place the ice bucket in fluid communication with the evaporation pan. A reservoir is coupled to the drain conduit. The reservoir includes a tank positioned above the evaporation pan. The tank defines an outlet. A plug assembly is positioned at the outlet of the tank. A float is mounted to the plug assembly and positioned within the evaporation pan.

In a second exemplary embodiment, a refrigerator appliance is provided. The refrigerator appliance includes a cabinet that defines a chilled chamber and a mechanical chamber. The refrigerator appliance also includes an evaporator positioned adjacent the chilled chamber of the cabinet and an evaporation pan positioned within the mechanical chamber of the cabinet. A drain conduit extends between an inlet and an outlet. The inlet of the drain conduit is positioned at the evaporator. The outlet of the drain conduit is positioned adjacent the evaporation pan. A reservoir is coupled to the drain conduit. The reservoir includes a tank positioned above the evaporation pan. The tank defines an outlet. A plug assembly is positioned at the outlet of the tank. A float is mounted to the plug assembly and positioned within the evaporation pan.

In a third exemplary embodiment, a refrigerator appliance is provided. The refrigerator appliance includes a cabinet that defines a chilled chamber and a mechanical chamber. An evaporation pan is positioned within the mechanical chamber of the cabinet. A drain conduit extends between an inlet and an outlet. The outlet of the drain conduit is positioned adjacent the evaporation pan. A reservoir is coupled to the drain conduit. The reservoir includes a plug assembly positioned at the outlet of the drain conduit. A float is mounted to the plug assembly and is positioned within the evaporation pan.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
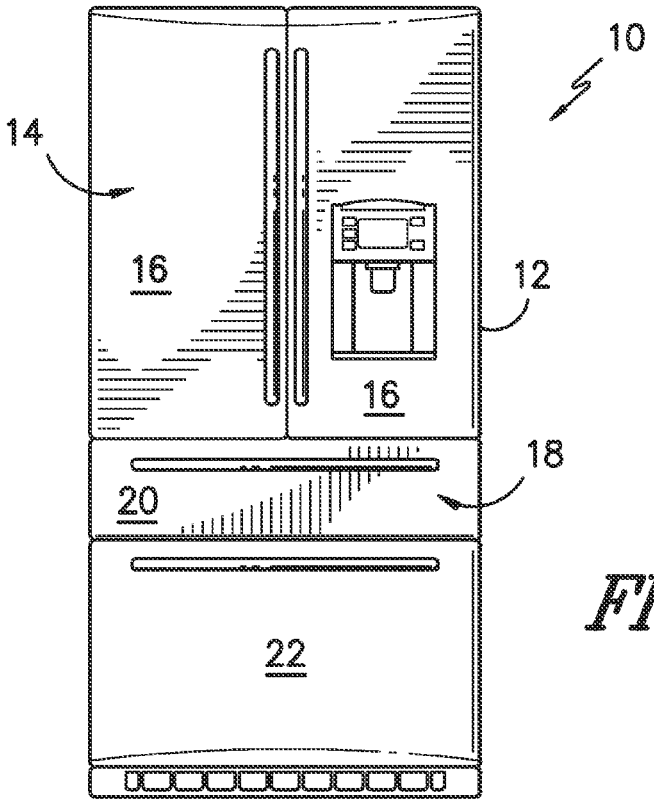
FIG. 1 is a front view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts a consumer refrigeration appliance 10 in the form of a refrigerator appliance that may incorporate a reservoir 100 in accordance with aspects of the present subject matter. It should be appreciated that the term "refrigerator appliance" is used in a generic sense herein to encompass any manner of refrigeration appliance, such as a freezer, refrigerator/freezer combination, and any style or model of conventional refrigerator. In the illustrated exemplary embodiment, refrigerator appliance 10 is depicted as an upright refrigerator having a cabinet or casing 12 that defines chilled compartments for storage of food items therein. In particular, the refrigerator appliance 10 includes upper fresh-food compartments 14 having doors 16 and lower freezer compartment 18 having upper drawer 20 and lower drawer 22. The drawers 20, 22 are "pull-out" drawers in that they can be manually moved into and out of the freezer compartment 18 on suitable slide mechanisms.

Figure 2:
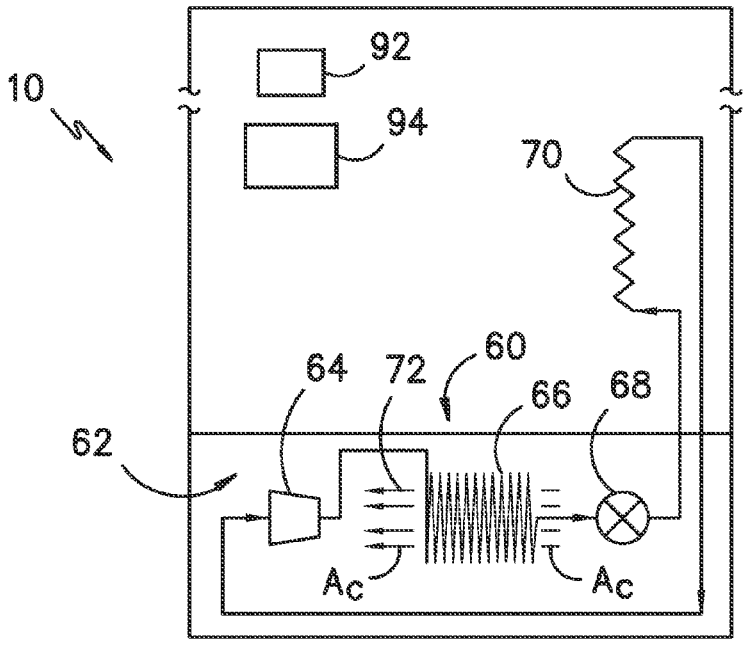
FIG. 2 is schematic view of certain components of the exemplary refrigerator appliance of FIG. 1.

FIG. 2 is a schematic view of certain component of refrigerator appliance 10 including a sealed refrigeration system 60. A machinery compartment 62 (e.g., positioned at a bottom portion of casing 12) contains components for executing a known vapor compression cycle for cooling air. The components include a compressor 64, a condenser 66, an expansion valve 68, and an evaporator 70 connected in series and charged with a refrigerant. As will be understood by those skilled in the art, sealed system 60 may include additional components, e.g., at least one additional evaporator, compressor, expansion valve, and/or condenser. As an example, sealed system 60 may include two evaporators.

Within sealed system 60, gaseous refrigerant flows into compressor 64, which operates to increase the pressure of the refrigerant. This compression of the refrigerant raises its temperature, which is lowered by passing the gaseous refrigerant through condenser 66. Within condenser 66, heat exchange with ambient air takes place so as to cool the refrigerant and cause the refrigerant to condense to a liquid state. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives liquid refrigerant from condenser 66. From expansion device 68, the liquid refrigerant enters evaporator 70. Upon exiting expansion device 68 and entering evaporator 70, the liquid refrigerant drops in pressure and, e.g., at least partially, vaporizes. Due to the pressure drop and phase change of the refrigerant, evaporator 70 is cool relative to compartments 14, 18 of refrigerator appliance 10 (FIG. 1). As such, cooled air is produced and configured to refrigerate compartments 14, 18 of refrigerator appliance 10 (FIG. 1). Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through refrigeration compartments 14, 18 (FIG. 1). The sealed system 60 depicted in FIG. 2 is provided by way of example only. Thus, it is within the scope of the present subject matter for other configurations of the sealed system to be used as well.

It should be understood that during operation of sealed system 60 water vapor, e.g., from air within refrigeration compartments 14, 18 (FIG. 1) can freeze upon contact with evaporator 70. For example, refrigerant within evaporator 70 may reach a temperature below the freezing point of water. Thus, water vapor contacting evaporator 70 may freeze and create a frost buildup (not shown) on evaporator 70. Such frost buildup may continue to grow during operation of sealed system 60. For example, when a user opens freezer doors 20, 22 and permits fresh water vapor containing air to enter freezer chamber 18.

Figure 3:
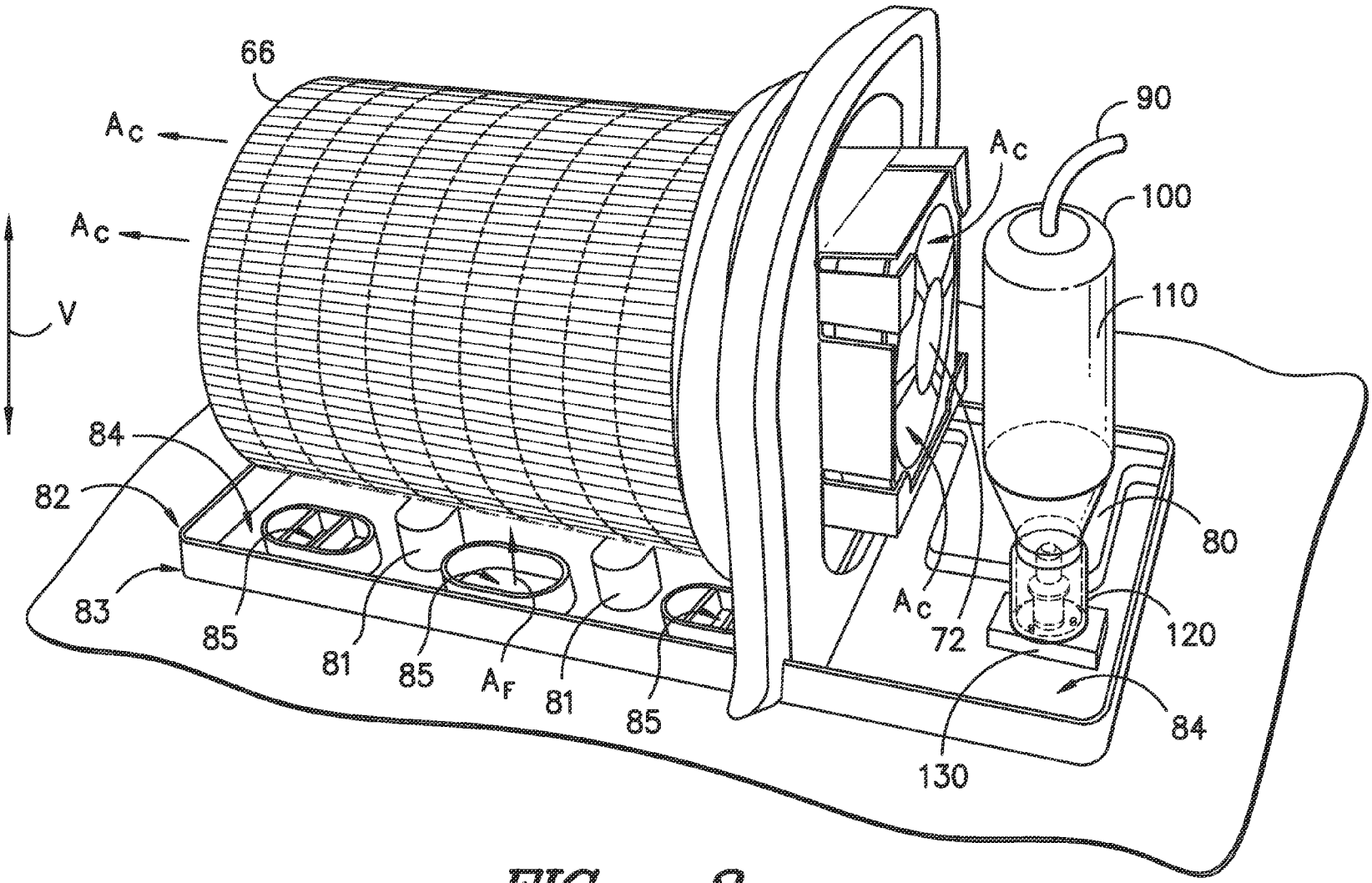
FIG. 3 illustrates a perspective view of a reservoir and evaporation pan of the exemplary refrigeration appliance of FIG. 1.

To avoid potential negative effects of such frost build up on sealed system 60 operation, sealed system 60 is configured for executing a defrost cycle. For example, sealed system 60 may deactivate compressor 64 for a period of time sufficient for the frost buildup on evaporator 70 to melt. As another example, a heating element may be activated to melt the frost buildup. However, when the frost buildup melts, a volume of liquid runoff (e.g, water) is produced that can freeze upon reactivation of compressor 64 and negatively affect sealed system 60 and, in particular, evaporator 70. Thus, such liquid runoff is directed away from evaporator 70 via a drain conduit 90 (FIG. 3). In the exemplary embodiment shown in FIG. 2, the liquid runoff is directed to a drain or evaporation pan 80 (FIG. 3) as discussed in greater detail below.

Refrigerator appliance 10 also includes an ice maker 92 and an ice bucket 94. Ice maker 92 is configured for generating or forming ice cubes. Ice cubes from ice maker 92 are directed to and stored within an ice bucket 94. Sealed system 60 can maintain air around ice bucket 94 below the freezing temperature of water in order to limit or prevent melting of ice cubes within ice bucket 94. However, sealed system 60 can stop functioning for a variety of reasons, such as disruption of an electrical power supply to sealed system 60, mechanical failure, etc. If ice cubes within ice bucket 94 are not maintained below the freezing temperature of water, ice cubes within ice bucket 94 melt and generate liquid runoff. Such liquid runoff can fill ice bucket 94 and negatively affect operation of refrigeration appliance 10. Thus, such liquid runoff is directed out of ice bucket 94 via drain conduit 90 (FIG. 3). In the exemplary embodiment shown in FIG. 2, the liquid runoff is directed to evaporation pan 80 (FIG. 3) as discussed in greater detail below.

FIG. 3 illustrates a perspective view of condenser 66 of sealed system 60 (FIG. 2) mounted above evaporation pan 80. Condenser 66 rests upon posts 81 that extend upwardly from evaporation pan 80 along the vertical direction V. As discussed above, fan 72 urges a flow of cooling air $A_C$ through condenser 66. It should be under stood that condenser 66 need not be supported by or mounted to evaporation pan 80 as shown in FIG. 3 and may be mounted above evaporation pan 80 in any suitable manner.

Evaporation pan 80 extends between a top portion 82 and a bottom portion 83 along the vertical direction V. Between top portion 82 and bottom portion 83, evaporation pan 80 defines a containment volume 84. Containment volume 84 is configured for receipt of the liquid runoff from evaporator 70 (FIG. 2) and/or ice bucket 94 as discussed above. Within containment volume 84, such liquid runoff is permitted to evaporate. More particularly, certain components of sealed system 60 and evaporation pan 80 may be directed towards facilitating and assisting evaporation of liquid runoff within containment volume 84. For example, condenser 66 operates at an elevated temperature relative to the liquid runoff. Thus, air about condenser 66 can be heated and assist evaporation of the liquid runoff. More directly, fan 72 can direct a portion of flow $A_C$ across and/or into containment volume 84 in order to assist evaporation of the liquid runoff.

Regarding evaporation pan 80, evaporation pan 80 defines vents or channels 85 for assisting evaporation of the liquid runoff. For example, channels 85 are configured for directing a flow of air $A_F$ through evaporation pan 80. Channels 85 direct air from bottom portion 83 to top portion 82 of evaporation pan 80 as discussed in greater detail below. As an example, air may be urged through channels 85 by convective currents generated by condenser 66. As heated air rises from condenser 66, cooler air within channels 85 may be drawn upwardly, and such air may assist in cooling condenser 66. Thus, e.g., condenser 66 may function more efficiently due to cooling air carried within flow $A_F$.

Refrigerator appliance 10 also includes a drain conduit 90. Drain conduit 90 is configured for directing liquid runoff from evaporator 70, ice bucket 94 and/or other components of refrigerator appliance 10 to evaporation pan 80. Thus, drain conduit 90 may extend between ice bucket 94 and evaporation pan 80 in order to place ice bucket 94 in fluid communication with evaporation pan 80. In particular, an inlet of drain conduit 90 may be positioned at or adjacent ice bucket 94, and an outlet of drain conduit 90 may be positioned at or adjacent evaporation pan 80. Drain conduit 90 may also extend between evaporator 70 and evaporation pan 80 in order to place evaporator 70 in fluid communication with evaporation pan 80. In particular, the inlet of drain conduit 90 may be positioned at or adjacent evaporator 70, and the outlet of drain conduit 90 may be positioned at or adjacent evaporation pan 80. Drain conduit 90 can have any suitable length. For example, a length of drain conduit 90 may be greater than about four feet.

As may be seen in FIG. 3, refrigerator appliance 10 also includes a reservoir 100 coupled to drain conduit 90. Reservoir 100 is configured for limiting or preventing overflows in evaporation pan 80. Thus, reservoir 100 includes features for regulating the flow of liquid runoff to evaporation pan 80 in order to limit or prevent overflows out of evaporation pan 80.

Figure 4:
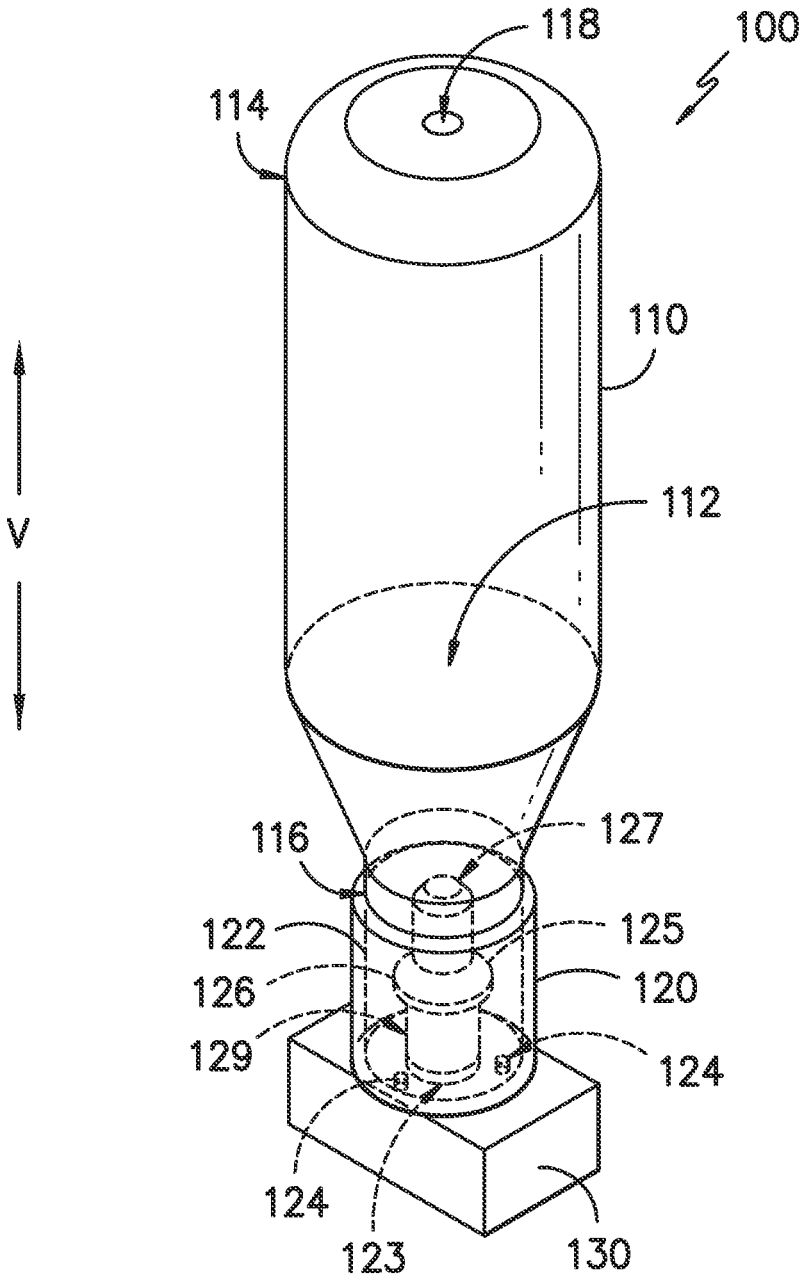
FIG. 4 provides a perspective view of the reservoir of FIG. 3.
Figure 5:
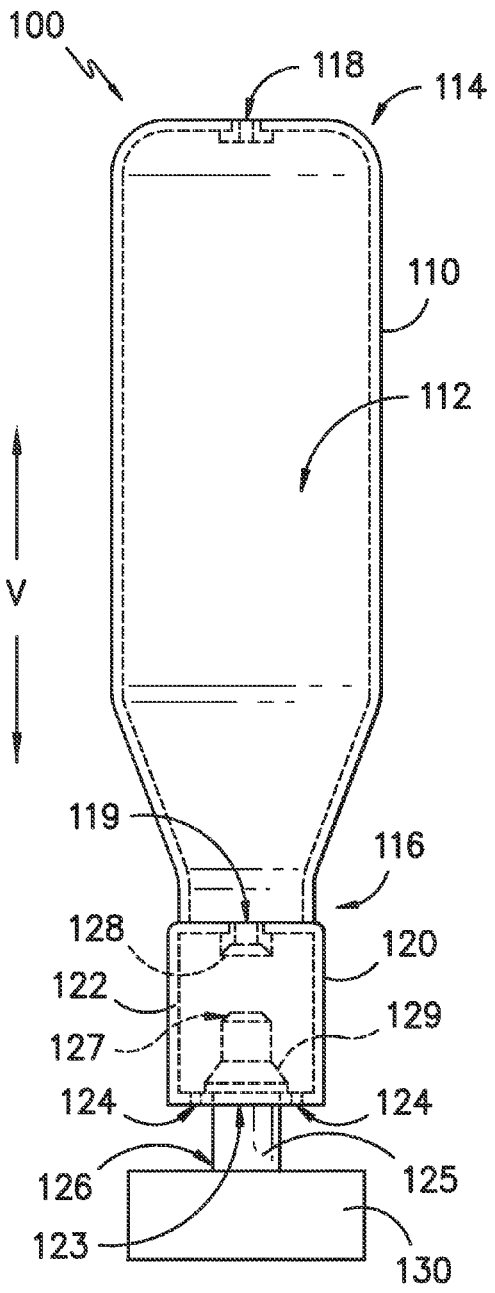
FIGS. 5 and 6 provide elevation views of the reservoir of FIG. 3 with a float of the exemplary reservoir shown in different positions.
Figure 6:
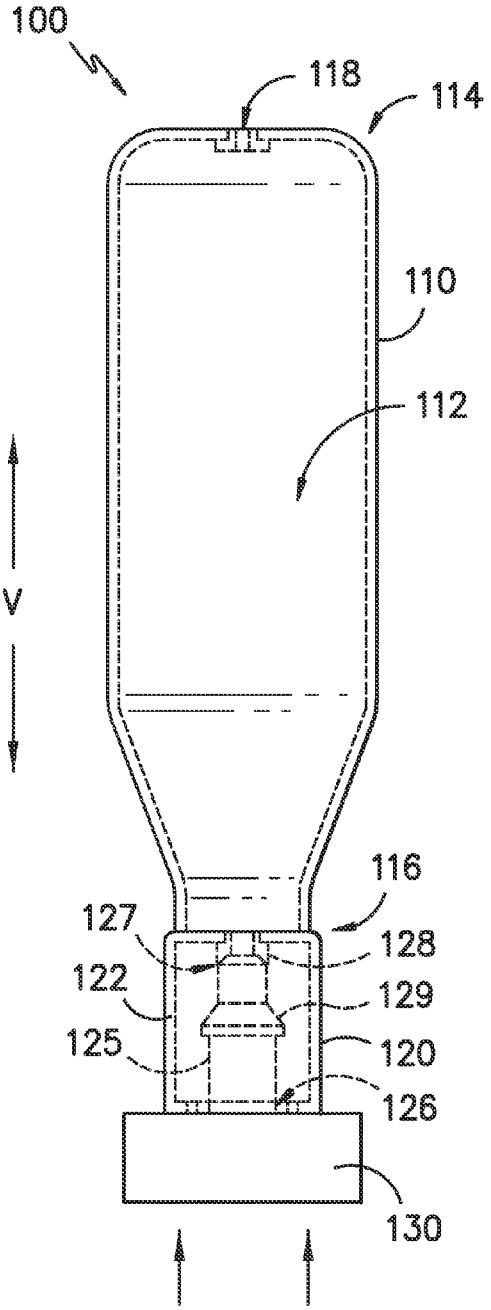

FIG. 4 provides a perspective view of reservoir 100. FIGS. 5 and 6 provide elevation views of reservoir 100 with a float 130 of reservoir 100 shown in different positions. Reservoir 100 includes a tank 110. Tank 110 may be positioned above evaporation pan 80 (FIG. 3). Tank 100 defines an interior volume 112 therein. Interior volume 112 of tank 110 is configured for receiving and storing liquid runoff therein. Interior volume 112 of tank 110 can be any suitable volume. For example, interior volume 112 of tank 110 may be smaller than containment volume 84 of evaporation pan 80. As another example, interior volume 112 of tank 110 may be greater than about sixteen fluid ounces. In particular, interior volume 112 of tank 110 may be sized to receive and contain enough liquid runoff to prevent excessive backup of liquid runoff within drain conduit 90 (FIG. 3).

Tank 110 extends between a top portion 114 and a bottom portion 116, e.g., along the vertical direction V. Tank 110 also defines an inlet 118 and an outlet 119 that permit fluid flow into and out of interior volume 112 of tank 110, respectively. Inlet 118 of tank 110 may be positioned at or adjacent top portion 114 of tank 110. Conversely, outlet 119 of tank 110 may be positioned at or adjacent bottom portion 116 of tank 110. In such a manner, gravity can assist with fluid flow through interior volume 112 of tank 110. In particular, gravity can urge liquid within interior volume 112 of tank 110 out of interior volume 112 of tank 110 through outlet 119 of tank 110 when outlet 119 of tank 110 is positioned at or adjacent bottom portion 116 of tank 110.

Reservoir 100 also includes a plug assembly 120. Plug assembly 120 is portioned at or adjacent outlet 119 of tank 110, e.g., and bottom portion 116 of tank 110. Reservoir 100 also includes a float 130. Float 130 is mounted to plug assembly 120 and may be positioned within evaporation pan 80, e.g., within containment volume 84 of evaporation pan 80. Float 130 is constructed of or with a material that is less dense than liquid water. For example, float 130 may be constructed or with a plastic foam, such as polystyrene foam. Thus, float 130 is less dense than liquid water 130 and floats.

Plug assembly 120 is configured for sealing or plugging outlet 119 of tank 110 depending upon the position of float 130 within containment volume 84 of evaporation pan 80. Plug assembly 120 includes a housing 122 and a plunger 125. Housing 122 is mounted to tank 110, e.g., at outlet 119 of tank 110. Plunger 125 is at least partially positioned within housing 122. Plunger 125 extends between a proximal end portion 126 and a distal end portion 127. Float 130 is mounted or coupled to plunger 125 at proximal end portion 126 of plunger 125. Thus, when float 130 moves, plunger 125 also moves. Movement of float 130 and plunger 125, e.g., relative to tank 110 or housing 122, can seal outlet 119 of tank 110 as discussed in greater detail below. As may be seen in FIG. 6, distal end portion 127 of plunger 125 is positionable within outlet 119 of tank 110 and can plug outlet 119 of tank 110.

Turning to FIGS. 5 and 6, plug assembly 120 also include a washer or seal 128. Seal 128 is mounted to housing 122, e.g., at or adjacent outlet 119 of tank 110. Distal end portion 127 of plunger 125 is positionable against seal 128, e.g., in order to assist with plugging outlet 119 of tank 110. In particular, distal end portion 127 of plunger 125 may be chamfered and seal 128 may be complementary shaped to receive the chamfered distal end portion 127 of plunger 125.

As may be seen in FIG. 4, housing 122 defines an opening 123 and a plurality of exits 124 distributed about opening 123. Exits 124 permit liquid within housing 122 to flow out of housing 122. Plunger 125 extends through opening 123 of housing 122. A flange 129 of plunger 125 can be larger than opening 123 of housing 122 in order to couple plunger 125 to housing 122 and prevent plunger 125 from separating from housing 122.

Figure 7:
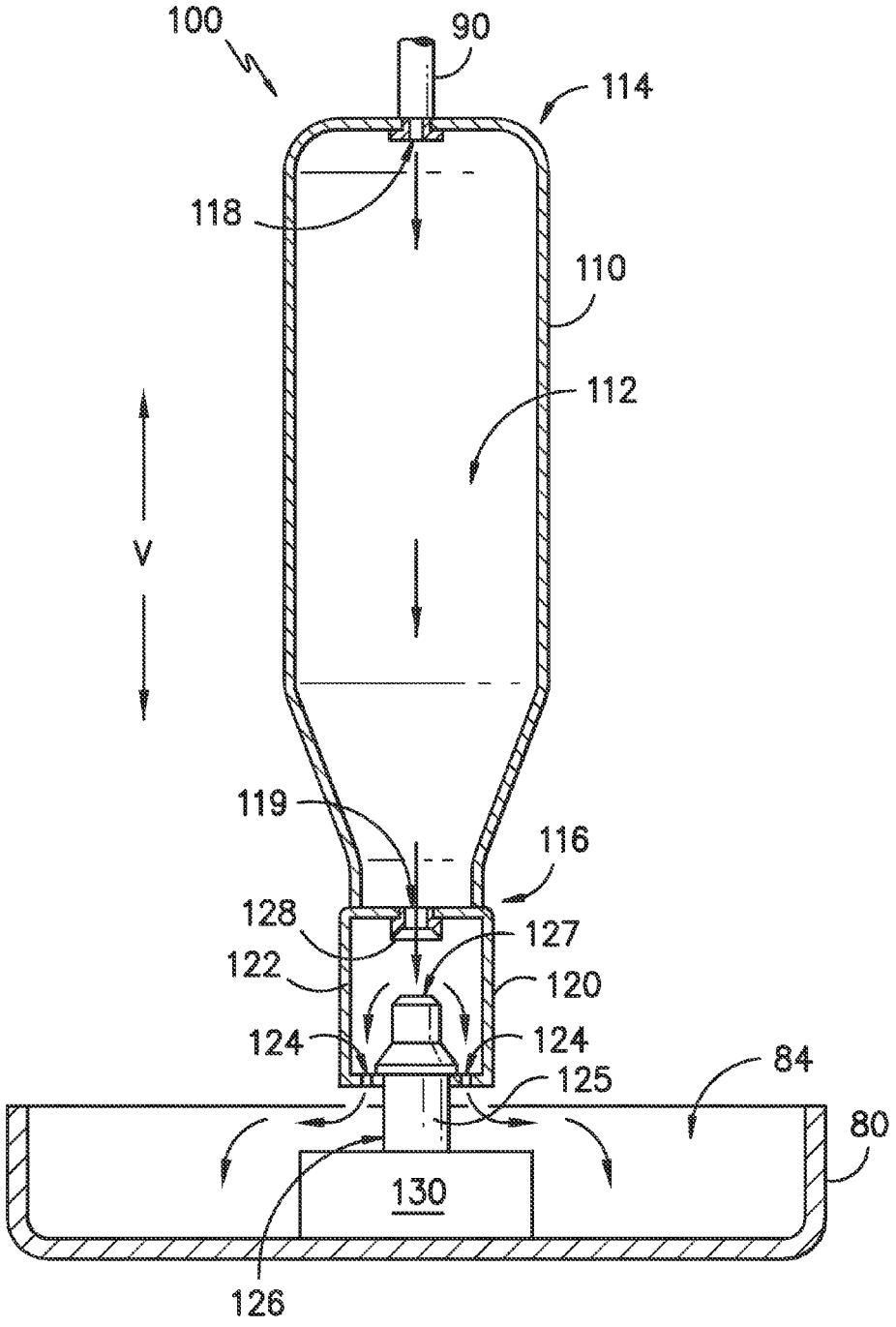
FIGS. 7, 8 and 9 provides section views of the reservoir and evaporation pan of FIG. 3 with various amounts of water within the reservoir and evaporation pan.
Figure 8:
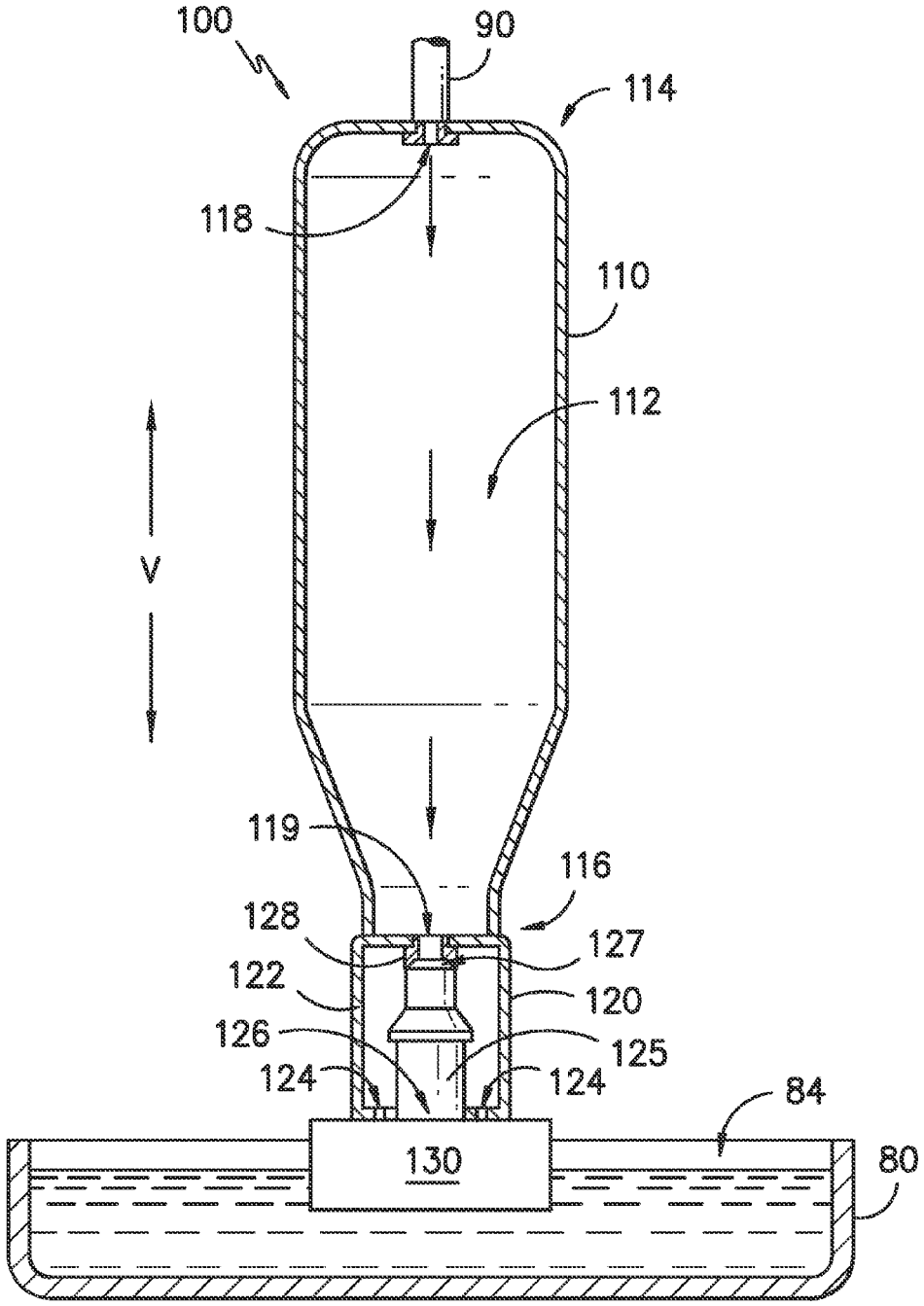
Figure 9:
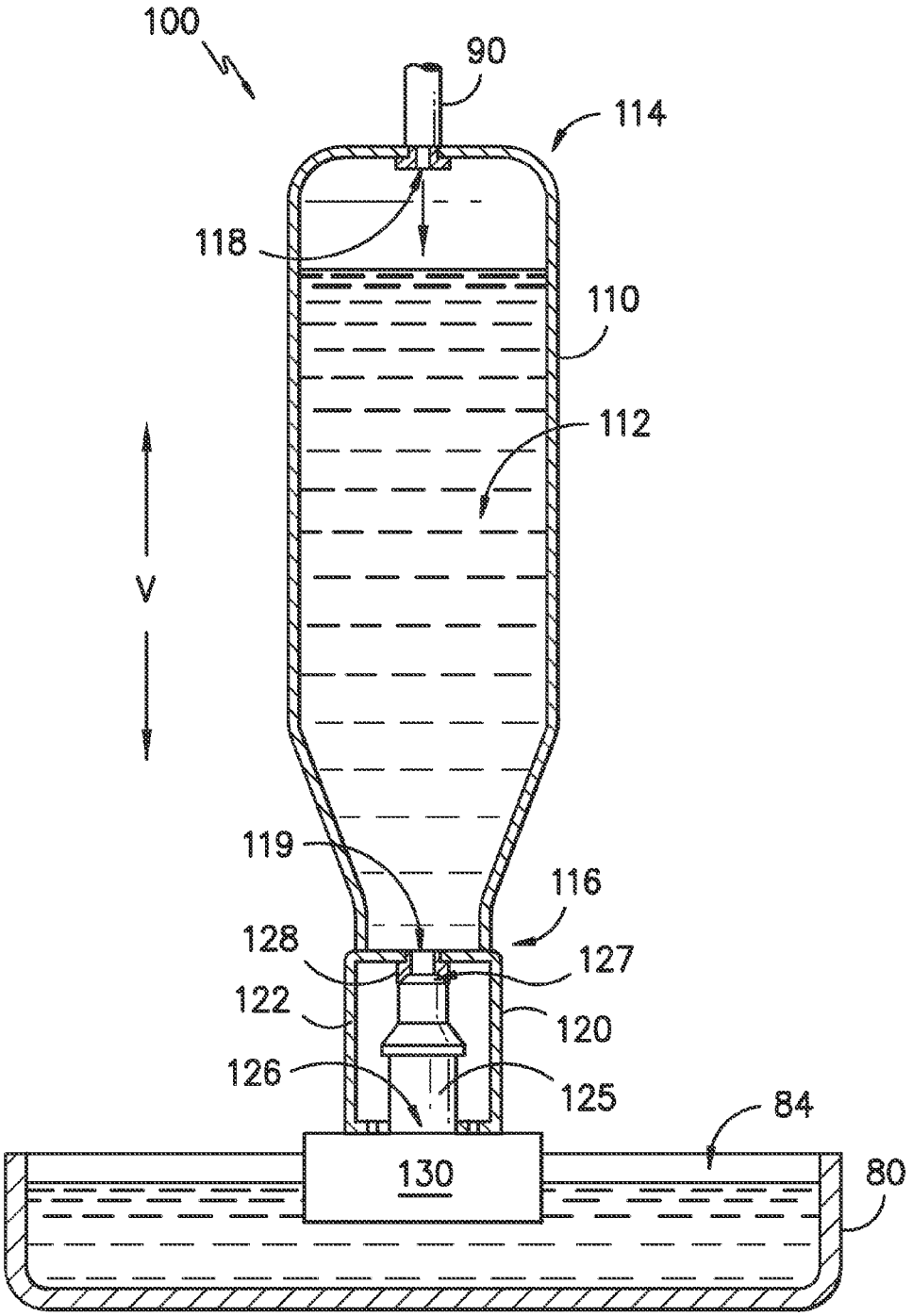

FIGS. 7, 8 and 9 provides section views of reservoir 100 and evaporation pan 80 with various amounts of water within reservoir 100 and evaporation pan 80. As discussed above, reservoir 100 regulates fluid flow to evaporation pan 80. In particular, when liquid within evaporation pan 80 raises float 130 to or above a particular height, plug assembly 120 seals outlet 119 of tank 110 and hinders or prevents additional liquid from flowing from reservoir 100 into evaporation pan 80 from drain conduit 90.

As an example, turning to FIG. 7, liquid from drain conduit 90 can flow into interior volume 112 of tank 110 at inlet 118 of tank 110. Because no liquid is disposed within containment volume 84 of evaporation pan 80, float 130 is in a lowered position and distal end portion 127 of plunger 125 is spaced from seal 128. Thus, liquid flows out tank 110 into housing 122 and into evaporation pan 80 via exits 124 of housing 122. However, as liquid flows from reservoir 100 into evaporation pan 80, the level of liquid within containment volume 84 of evaporation pan 80 rises, and float 130 moves upwardly. As float 130 moves upwardly, distal end portion 127 of plunger 125 approaches seal 128 and outlet 119 of tank 110.

Turning now to FIG. 8, when liquid within evaporation pan 80 raises float 130 to or above a particular height and float 130 is in a raised position, distal end portion 127 of plunger 125 engages seal 128 and plug assembly 120 seals or plugs outlet 119 of tank 110. Thus, plug assembly 120 (e.g., plunger 125) hinders or prevents additional liquid from flowing from reservoir 100 into evaporation pan 80 when float 130 is in the raised position.

As may be seen in FIG. 9, liquid from drain conduit 90 collects within interior volume 112 of tank 110 when float 130 is in the raised position and distal end portion 127 of plunger 125 engages seal 128. In such a manner, reservoir 100 can collect and store liquid from drain conduit 90 when evaporation pan 80 is full and prevent evaporation pan 80 from overflowing. In turn, as liquid in evaporation pan 80 evaporates and the level of liquid within containment volume 84 of evaporation pan 80 drops, float 130 also drops. As float 130 drops, plug assembly 120 disengages and permits liquid within interior volume 112 of tank 110 to flow into evaporation pan 80. Thus, reservoir 100 is self-regulating and can mechanically (e.g., without electricity) limit or prevent excessive fluid flow from drain conduit 90 to evaporation pan 80.

It should be understood that while described in the context of the exemplary reservoir 100 of FIGS. 3-9, reservoir 100 need not include tank 110 in alternative exemplary embodiments. In such exemplary embodiments, plug assembly 120 may be directly coupled or mounted to drain conduit 90, and plug assembly 120 may limit or prevent excessive fluid flow from drain conduit 90 to evaporation pan 80. Excess water can be collected and stored within drain conduit 90 rather than tank 110 in such exemplary embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a chilled chamber and a mechanical chamber;

an ice bucket;

an evaporation pan positioned within the mechanical chamber of the cabinet;

a drain conduit extending between the ice bucket and the evaporation pan in order to place the ice bucket in fluid communication with the evaporation pan; and a reservoir coupled to the drain conduit, the reservoir comprising a tank positioned above the evaporation pan, the tank defining an outlet;

a plug assembly positioned at the outlet of the tank; and a float mounted to the plug assembly and positioned within the evaporation pan, wherein the tank defines an interior volume and the evaporation pan defines an interior volume, the interior volume of the tank being smaller than the interior volume of the evaporation pan.

2. The refrigerator appliance of claim 1, further comprising a condenser positioned above the evaporation pan.

3. The refrigerator appliance of claim 2, wherein the condenser is mounted to the evaporation pan.

4. The refrigerator appliance of claim 2, further comprising a fan positioned at the evaporation pan, the fan positioned and oriented for directing a flow of air across the condenser.

5. The refrigerator appliance of claim 1, wherein the mechanical chamber is positioned adjacent a bottom portion of the cabinet.

6. The refrigerator appliance of claim 1, wherein the interior volume of the tank is greater than about sixteen fluid ounces.

7. The refrigerator appliance of claim 1, wherein the plug assembly comprises a housing mounted to the tank and a plunger, the plunger extending between a distal end portion and a proximal end portion, the float mounted to the plunger at the proximal end portion of the plunger, the distal end portion of the plunger positioned within and plugging the outlet of the tank when liquid water within the evaporation pan raises the float to a particular height.

8. The refrigerator appliance of claim 7, wherein the plug assembly further comprises a seal mounted to the housing at the outlet of the tank, the plunger positioned against the seal when liquid water within the evaporation pan raises the float to the particular height.

9. The refrigerator appliance of claim 7, wherein the housing defines an opening and a plurality of exits distributed about the opening, the plunger extending through the opening of the housing.

10. The refrigerator appliance of claim 1, wherein the float comprises polystyrene foam.

11. The refrigerator appliance of claim 1, wherein a length of the drain conduit is greater than about four feet.

* * * * *